United States Patent [19]

Sung

[11] Patent Number: 4,865,621

[45] Date of Patent: Sep. 12, 1989

[54] ORI-INHIBITED AND DEPOSIT-RESISTANT MOTOR FUEL COMPOSITION

[75] Inventor: Rodney Lu-Dai Sung, Fishkill, N.Y.

[73] Assignee: Texaco Inc., White Plains, N.Y.

[21] Appl. No.: 302,492

[22] Filed: Jan. 27, 1989

[51] Int. Cl.[4] ..... C10L 1/14

[52] U.S. Cl. ..... 44/62; 44/72

[58] Field of Search ..... 44/62, 71, 72

[56] References Cited

U.S. PATENT DOCUMENTS

| | | | |
|---|---|---|---|
| 3,438,757 | 4/1969 | Honnen et al. | 44/58 |
| 4,357,148 | 11/1982 | Graiff | 44/62 |
| 4,604,103 | 8/1986 | Campbell | 44/72 |
| 4,643,738 | 2/1987 | Sung et al. | 44/63 |
| 4,659,336 | 4/1987 | Sung et al. | 44/62 |
| 4,659,337 | 4/1987 | Sung | 44/63 |
| 4,747,851 | 5/1988 | Sung et al. | 44/72 |
| 4,810,261 | 3/1989 | Sung et al. | 44/62 |

*Primary Examiner*—Jacqueline V. Howard

*Attorney, Agent, or Firm*—Robert A. Kulason; James J. O'Loughlin

[57] ABSTRACT

A motor fuel composition which inhibits engine ORI and resists engine and carburetor deposit formation comprises a mixture of hydrocarbons boiling in the range of 90° F.–450° F. and the reaction product of a dibasic acid anhydride, a polyoxyalkylene monoamine, and a hydrocarbyl polyamine.

14 Claims, No Drawings

ORI-INHIBITED AND DEPOSIT-RESISTANT MOTOR FUEL COMPOSITION

BACKGROUND OF THE INVENTION

1. Field of the Invention

This invention relates to an ORI-inhibited and deposit-resistant motor fuel composition. More particularly, this invention relates to a motor fuel composition comprising a reaction product obtained by reacting a dibasic acid anhydride, a polyoxyalkylene monoamine, and a hydrocarbyl polyamine.

2. Information Disclosure Statement

Co-assigned U.S. patent application Ser. No. 302,495, filed Jan. 27, 1989 discloses an ORI-inhibited and deposit-resistant motor fuel composition comprising a minor amount of the reaction product of a dibasic acid anhydride, a polyoxyalkylene diamine, and a heterocyclic azole.

Co-assigned U.S. patent application Ser. No. 245,591, filed Sept. 19, 1988 discloses an ORI-inhibited motor fuel composition comprising the reaction product of one or more aliphatic carboxylic acids and a polyoxyalkylene diamine.

Co-assigned U.S. patent application Ser. No. 211,937, filed June 27, 1988, discloses a motor fuel composition comprising the reaction product of (i) a hydrocarbyl-substituted dibasic acid anhydride and (ii) a polyoxyalkylene diamine and an optional polymeric component which is a polyolefin polymer/copolymer, or mixtures thereof, of a $C_2$–$C_{10}$ hydrocarbon.

Co-assigned U.S. patent application Ser. No. 84,354, filed Aug. 12, 1987 discloses a motor fuel composition comprising (I) the reaction product of the polyoxyalkylene diamine of co-assigned U.S. Pat. No. 4,747,851, a dibasic acid anhydride, and a hydrocarbyl polyamine, and (II) a mixture comprising polyisobutylene ethylene diamine and polyisobutylene in a hydrocarbon solvent.

Co-assigned U.S. patent application Ser. No. 58,424 filed Feb. 19, 1988 discloses a motor fuel composition comprising the reaction product of the polyoxyalkylene diamine of U.S. Pat. No. 4,747,851, a dibasic acid anhydride, and a hydrocarbyl polyamine. An optional additional polymer/copolymer additive with a molecular weight of 500–3500 may also be employed in conjunction with the reaction product additive.

Co-assigned U.S. Pat. No. 4,747,851 discloses a motor fuel composition comprising a polyoxyalkylene diamine compound of the formula:

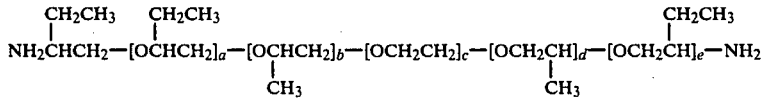

where c has a value from about 5–150, b+d has a value from about 5–150, and a+e has a value from about 2–12, either alone or in combination with a polymer/copolymer additive.

Co-assigned U.S. Pat. No. 4,659,337 discloses the use of the reaction product of maleic anhydride, a polyether polyamine containing oxyethylene and oxypropylene ether moieties, and a hydrocarbyl polyamine in a gasoline motor fuel to reduce engine ORI and provide carburetor detergency.

Co-assigned U.S. Pat. No. 4,659,336 discloses the use of the mixture of: (i) the reaction product of maleic anhydride, a polyether polyamine containing oxyethylene and oxypropylene ether moieties, and a hydrocarbyl polyamine; and (ii) a polyolefin polymer/copolymer as an additive in motor fuel compositions to reduce engine ORI.

U.S. Pat. No. 4,604,103 discloses a motor fuel deposit control additive for use in internal combustion engines which maintains cleanliness of the engine intake system without contributing to combustion chamber deposits or engine ORI. The additive disclosed is a hydrocarbyl polyoxyalkylene polyamine ethane of molecular weight range 300–2500 having the formula

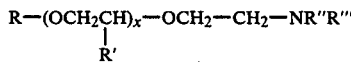

where R is a hydrocarbyl radical of from 1 to about 30 carbon atoms; R′ is selected from methyl and ethyl; x is an integer from 5 to 30; and R″ and R‴ are independently selected from hydrogen and $-(CH_2CH_2NH-)_y-H$ where y is an integer from 0–5.

Co-assigned U.S. Pat. No. 4,207,079 discloses a motor fuel composition comprising an effective amount of a reaction product additive which is the reaction product of about 2 moles of an n-alkyl-alkylene diamine and about 1 mole of maleic anhydride.

U.S. Pat. No. 4,198,306 discloses the use of hydrocarbyl poly (oxyalkylene) aminoesters which are monoesters of a hydrocarbyl-terminated poly (oxyalkylene) alcohol and a monocarboxylic $C_2$–$C_{20}$ (amino-substituted) alkanoic acid as an ORI-controlling additive in motor fuel compositions.

Co-assigned U.S. Pat. No. 3,773,479 discloses a motor fuel composition comprising a minor amount of an asparagine compound prepared by reacting maleic anhydride and a secondary or tertiary hydrocarbyl amine.

U.S. Pat. No. 3,236,613 discloses a petroleum distillate composition comprising an additive which is the reaction product of an aliphatic dicarboxylic acid anhydride, an aliphatic primary amine, an alkylene polyamine, and salicylaldehyde.

SUMMARY OF THE INVENTION

According to this invention, an ORI-inhibited and deposit-resistant motor fuel composition comprises a mixture of hydrocarbons boiling in the range from about 90°–450° F. and additionally comprises from about 0.0005–5.0 weight percent of the reaction product obtained by reacting, at a temperature of about 30°–200° C.:

(a) 0.5–2.5 moles of a dibasic acid anhydride;

(b) 0.5–1.5 moles of a polyoxyalkylene monoamine of the formula

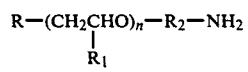

where R is a $C_1$–$C_{20}$ hydrocarbyl radical, $R_1$ is H or a $C_1$–$C_5$ hydrocarbyl radical, $R_2$ is a $C_1$–$C_{10}$ alkylene group, and n has a value of 1–10.

(c) 0.5–1.5 moles of a hydrocarbyl polyamine of the formula $$R_4(NH—R_3)_x—NH_2$$

where $R^4$ is a $C_1$–$C_{24}$ alkyl radical, $R_3$ is a $C_1$–$C_6$ alkylene group, and x has a value of 1–10.

DETAILED EMBODIMENTS OF THE INVENTION

Combustion of a hydrocarbon motor fuel in an internal combustion engine generally results in the formation and accumulation of deposits on various parts of the combustion chamber as well as on the fuel intake and exhaust systems of the engine. The presence of deposits in the combustion chamber seriously reduces the operating efficiency of the engine. First, deposit accumulation within the combustion chamber inhibits heat transfer between the chamber and the engine cooling system. This leads to higher temperatures within the combustion chamber, resulting in increases in the end gas temperature of the incoming charge. Consequently, end gas auto-ignition occurs, which causes engine knock. In addition, the accumulation of deposits within the combustion chamber reduces the volume of the combustion zone, causing a higher than design compression ratio in the engine. This, in turn, also results in serious engine knocking. A knocking engine does not effectively utilize the energy of combustion. Moreover, a prolonged period of engine knocking will cause stress fatigue and wear in vital parts of the engine. The above-described phenomenon is characteristic of gasoline powered internal combustion engines. It is usually overcome by employing a higher octane gasoline for powering the engine, and hence has become known as the engine octane requirement increase (ORI) phenomenon. It would therefore be highly advantageous if engine ORI could be substantially reduced or eliminated by preventing or modifying deposit formation in the combustion chambers of the engine.

Another problem common to internal combustion engines relates to the accumulation of deposits in the carburetor which tend to restrict the flow of air through the carburetor at idle and at low speed, resulting in an over-rich fuel mixture. This condition also promotes incomplete fuel combustion and leads to rough engine idling and engine stalling. Excessive hydrocarbon and carbon monoxide exhaust emissions are also produced under these conditions. It would therefore be desirable from the standpoint of engine operability and overall air quality to provide a motor fuel composition which minimizes or overcomes the abovedescribed problems.

It is an object of this invention to provide a motor fuel composition which exhibits deposit-resistance and ORI-inhibition when employed in an internal combustion engine.

It is a feature of motor fuel compositions of the instant invention that combustion chamber deposit formation is minimized, with concomitant reduction of engine ORI.

It is an advantage that motor fuel compositions of the instant invention exhibit reduced deposit formation and engine ORI.

The ORI-inhibited and deposit-resistant motor fuel composition of the instant invention comprises a reaction product additive which is obtained by reacting a dibasic acid anhydride, a polyoxyalkylene monoamine, and a hydrocarbyl polyamine. The dibasic acid anhydride reactant used to prepare the reaction product is preferably selected from the group consisting of maleic anhydride, alpha-methyl maleic anhydride, alpha-ethyl maleic anhydride, and alpha, beta-dimethyl maleic anhydride. The most preferred dibasic acid anhydride for use is maleic anhydride.

The polyoxyalkylene monoamine reactant used to prepare the reaction product is a diamine of the formula $$R—(CH_2\underset{\underset{R_1}{|}}{C}HO)_n—R_2—NH_2$$

where R is a $C_1$–$C_{20}$, preferably a $C_{10}$–$C_{18}$ hydrocarbyl radical, most preferably a $C_{10}$–$C_{12}$ hydrocarbyl radical, $R_1$ is H or a $C_1$–$C_5$ hydrocarbyl radical, preferably a $C_1$–$C_3$ hydrocarbyl radical, most preferably $CH_3$, $R_2$ is a $C_1$–$C_{10}$ alkylene group, preferably a $C_1$–$C_5$ alkylene group, most preferably a propylene group, and n has a value of 1–10, preferably 1–5.

Polyoxyalkylene monoamine reactants suitable for use include the JEFFAMINE M - series polyoxyalkylene monoamines available from Texaco Chemical Company. JEFFAMINE M - series polyoxyalkylene monoamines are prepared by reaction of a monohydric alcohol initiator with ethylene oxide (EO) or propylene oxide (PO) followed by conversion of the resulting terminal hydroxyl group to an amine. Any of the JEFFAMINE products set forth in the table below may be employed as the polyoxyalkylene monoamine reactant used to produce the reaction product, with the JEFFAMINE compounds having an approximate molecular weight of less than 1000 being particularly preferred.

| JEFFAMINE | Mol. Ratio PO/EO | Approx. Mol. Wt. |
|---|---|---|
| M-300 | 2/0 | 300 |
| M-360 | 2/3 | 360 |
| M-600 | 9/0 | 600 |
| M-1000 | 3/18 | 1000 |
| M-2005 | 32/2 | 2000 |
| M-2070 | 10/31 | 2000 |

The hydrocarbyl polyamine reactant used to prepare the reaction product is a polyamine of the formula $$R_4(NH—R_3)_z—NH_2$$

where $R_4$ is an alkyl radical having from about 1–24, preferably 12–20 carbon atoms, $R_3$ is an alkylene radical having from about 1–6 carbon atoms, and z has a value from about 1–10, preferably 1–5. The preferred hydrocarbyl polyamine reactant for use is an n-alkyl-alkylene diamine of the formula:

$$R_5—NH—(CH_2)_z—NH_2$$

where $R_5$ is an aliphatic hydrocarbyl radical having from about 8 to 24 carbon atoms, preferably from about 12 to 20 carbon atoms, and z has a value from about 1 to 5, preferably having a value of 3. N-alkyl-alkylene diamines suitable for use in preparing the reaction product of the instant invention include aliphatic diamines commercially available from Akzo Chemie America Co. under the DUOMEEN series trade name. Examples of such n-alkyl-alkylene diamines include n-coco-1,3-diaminopropane(DUOMEEN C), n-soya-1,3-diaminopropane(DUOMEEN S), n-tallow-1,3-diaminopropane(DUOMEEN T), and n-oleyl-1,3-diaminopropane(DUOMEEN OL).

The reaction product additive of the instant invention is prepared by first reacting 0.5–2.5 moles, preferably about 1 mole of the abovedescribed dibasic acid anhydride with 0.5–1.5 moles, preferably about 1 mole of the abovedescribed polyoxyalkylene monoamine and 0.5–1.5 moles, preferably 1 mole of the prescribed polyoxyalkylene monoamine reactant, at a temperature of 30° C.–200° C., preferably 90° C. –150° C. to produce a maleamic acid amide. The reaction is preferably carried out in the presence of a solvent. Suitable solvents include hydrocarbons boiling in the gasoline boiling range of about 30° C. to about 200° C. Generally, this will include saturated and unsaturated hydrocarbons having from about 5 to about 10 carbon atoms. Specific suitable hydrocarbon solvents include tetrahydrofuran, hexane, cyclohexane, benzene, toluene, and mixtures thereof. Xylene is the preferred solvent. The solvent can be present in an amount of up to about 90% by weight of the total reaction mixture. Once the reaction has been completed, the maleamic acid amide may be separated from the solvent using conventional means, or left in admixture with some or all of the solvent.

The maleamic acid amide, either alone or in solution with the abovedescribed solvent, is thereafter reacted with 0.5–1.5 moles, preferably 1 mole of the prescribed n-alkyl-alkylene diamine reactant at a temperature of about 90°–150° C. Once the reaction has been completed, the reaction product may be separated from the solvent using conventional means, or left in admixture with some or all of the solvent.

The following examples illustrate the preferred method of preparing the reaction product of the instant invention. It will be understood that the following examples are merely illustrative, and are not meant to limit the invention in any way. In the examples, all parts are parts by weight unless otherwise specified.

EXAMPLE I 98 parts of maleic anhydride, 388 parts of xylene, and 289.7. parts of a polyoxyalkylene monoamine (JEFFAMINE M-300) were reacted at a temperature of about 100 C for approximately 2 hours to produce a maleamic acid amide. One-half of the reaction product mixture was thereafter reacted with 142 parts of n-tallow-1,3-diaminopropane (DUOMEEN T) at a temperature of about 100° C. for approximately 2 hours to produce the final reaction product additive. The reaction product was filtered and stripped of remaining solvent under vacuum, and identified by IR, NMR, and elemental analysis.

EXAMPLE II 25 parts of maleic anhydride, 285 parts of hexane, 246 parts of xylene, and 143.7 parts of a polyoxyalkylene monoamine (JEFFAMINE M-600) were reacted at a temperature of about 100° C. for approximately 2 hours to produce a maleamic acid amide. Thereafter, 94 parts of n-tallow-1,3-diaminopropane (DUOMEEN T) were reacted with the maleamic acid amide at a temperature of about 100° C. for approximately 2 hours to produce the final reaction product additive. The reaction product was filtered and stripped of remaining solvent under vacuum, and identified by IR, NMR and elemental analysis.

EXAMPLE III 12 parts of maleic anhydride, 265 parts of hexane, 346 parts of xylene, and 153.8 parts of a polyoxyalkylene monoamine (JEFFAMINE M-1000) were reacted at a temperature of about 100° C. for approximately 2 hours to produce a maleamic acid amide. Thereafter, 47 parts of n-tallow-1,3-diaminopropane (DUOMEEN T) and the abovedescribed maleamic acid amide were reacted at a temperature of about 100° C. for approximately 2 hours to produce the final reaction product additive. The reaction product was filtered and stripped of remaining solvent under vacuum, and identified by IR, NMR and elemental analysis.

EXAMPLE IV 98 parts of maleic anhydride, 1046.8 parts of xylene, and 574.8 parts of a polyoxyalkylene monoamine (JEFFAMINE M-600) were reacted at a temperature of about 100° C. for approximately 2 hours to produce a maleamic acid amide. Thereafter, 350 parts of n-oleyl-1,3-diaminopropane (DUOMEEN OL) and the abovedescribed maleamic acid amide were reacted at a temperature of about 100° C. for approximately 2 hours to produce the final reaction product additive. The reaction product was filtered and stripped of remaining solvent under vacuum, and identified by IR, NMR and elemental analysis.

EXAMPLE V 49 parts of maleic acid, 345 parts xylene, 264 parts hexane, and 144.8 parts of a polyoxyalkylene monoamine (JEFFAMINE M-300) were reacted at a temperature of about 100° C. for approximately 2 hours to produce a maleamic acid amide. Thereafter, the mixture was cooled to about 60° C. and 187 parts of n-tallow-1,3-diaminopropane (DUOMEEN T) and the abovedescribed maleamic acid amide were reacted at a temperature of about 100° C. for approximately 2 hours to form the final reaction product additive. The reaction product was filtered and stripped of remaining solvent under vacuum, and identified by IR, NMR, and elemental analysis.

EXAMPLE VI 12 parts of maleic acid, 346 parts xylene, 265 parts hexane, and 153.8 parts of a polyoxyalkylene monoamine (JEFFAMINE M-1000) were reacted at a temperature of about 100° C. for approximately 2 hours to produce a maleamic acid amide. Thereafter, the mixture was cooled to about 60° C. and 47 parts of n-tallow-1,3-diaminopropane (DUOMEEN T) and the abovedescribed maleamic acid amide were reacted at a temperature of about 100° C. for approximately 2 hours to form the final reaction product additive. The reaction product was filtered and stripped of remaining solvent under vacuum, and identified by IR, NMR, and elemental analysis.

EXAMPLE VII 25 parts of maleic acid, 346 parts xylene, 265 parts hexane, and 143.7 parts of a polyoxyalkylene monoamine (JEFFAMINE M-600) were reacted at a temperature of about 100° C. for approximately 2 hours to produce a maleamic acid amide. Thereafter, the mixture was cooled to about 60° C. and 94 parts of n-tallow-1,3-diaminopropane (DUOMEEN T) and the abovedescribed maleamic acid amide were reacted at a temperature of about 100° C. for approximately 2 hours to form the final reaction product additive. The reaction product was filtered and stripped of remaining solvent under vacuum, and identified by IR, NMR, and elemental analysis.

The motor fuel composition of the instant invention comprises a major amount of a base motor fuel and 0.0005–5.0 weight percent, preferably 0.001–1.0 weight percent of the abovedescribed reaction product. Preferred base motor fuel compositions are those intended for use in spark ignition internal combustion engines. Such motor fuel compositions, generally referred to as gasoline base stocks, preferably comprise a mixture of hydrocarbons boiling in the gasoline boiling range, preferably from about 90° F. to about 450° F. This base fuel may consist of straight chains or branched chains or paraffins, cycloparaffins, olefins, aromatic hydrocarbons, or mixtures thereof. The base fuel can be derived from, among others, straight run naphtha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention. An example of a motor fuel composition of the instant invention is set forth in Example VIII, below.

EXAMPLE VIII

100 PTB of the reaction product set forth in Example IV (i.e. 100 pounds of reaction product per 1000 barrels of gasoline, equivalent to about 0.01 weight percent of reaction product based on the weight of the fuel composition) is blended with a major amount of a base motor fuel (herein designated as Base Fuel A) which is a premium grade gasoline essentially unleaded (less than 0.05 g of tetraethyl lead per gallon), comprising a mixture of hydrocarbons boiling in the gasoline boiling range consisting of about 22% aromatic hydrocarbons, 11% olefinic carbons, and 67% paraffinic hydrocarbons, boiling in the range from about 90° F. to 450° F.

It has been demonstrated that a motor fuel composition comprising a minor amount of the reaction product composition of the instant invention is effective in minimizing and reducing gasoline internal combustion engine deposits. This is an improvement in the fuel performance which may reduce the incidence of engine knock. Several motor fuel compositions of the instant invention were tested by the Combustion Chamber Deposit Screening Test (CCDST). In this test, the deposit-forming tendencies of a gasoline are measured. The amount of deposit formation correlates well with the ORI performance observed in car tests and engine tests. The amount of deposit is compared to a high reference (a standard gasoline known to have a high deposit formation) and a low reference (an unleaded base fuel which is known to have a low deposit formation).

The CCDST determines whether the additive in question is effective as a deposit control additive to prevent ORI. In this test, the additive samples of the reaction product compositions to be tested were first dissolved in 3.0 wt. % methanol and thereafter dissolved in Base Fuel A in a concentration of 100 PTB (100 pounds of additive per 1000 barrels of fuel, equivalent to about 0.033 weight percent of additive). In a nitrogen/hot air environment the gasoline was then atomized and sprayed onto a heated aluminum tube. After 100 minutes, the deposits which were formed on the tube were weighed. Gasolines which form larger amounts of deposits on the heated aluminum tube cause the greatest ORI when employed in an internal combustion engine. The CCDST was also employed to measure the deposit tendencies of a high reference fuel (Example H), known to yield a large deposit, and a low reference fuel (Example L), a standard unleaded gasoline known to yield a low deposit. The results are summarized below:

| | CCDST Results (mg) | | |
|---|---|---|---|
| Sample Tested | Example L | Example H | Sample Result |
| Base Fuel A + 100 PTB Example I | 3.5 | 11.3 | 8.2 |
| Base Fuel A + 100 PTB Example II | 4.0 | 11.3 | 4.2 |
| Base Fuel A + 100 PTB Example III | 3.5 | 11.3 | 6.3 |
| Base Fuel A + 100 PTB Example IV | 2.9 | 6.7 | 4.3 |
| Base Fuel A + 100 PTB Example VII | 4.0 | 11.3 | 4.2 |

The above results illustrate that motor fuel compositions of the instant invention were moderately superior to the high reference standard fuel in terms of resistance to deposit formation, and consequently in terms of ORI-inhibition.

Although the abovedescribed CCDST results illustrate that Examples I–IV are approximately equivalent in terms of ORI inhibition, further testing has illustrated that the use of a polyoxyalkylene monoamine reactant having an approximate molecular weight less than 1000 is particularly preferred in forming the reaction product additive of the instant invention. This has been demonstrated by the Chevrolet Carburetor Detergency Test Phase III (CCDT-III) and the Chevrolet Carburetor Detergency Test - Keep Clean (CCDT-KC).

The CCDT-III test is run on a Chevrolet V-8 engine mounted on a test stand using a modified four barrel carburetor. The two secondary barrels of the carburetor are sealed, and the feed to each of the primary barrels is arranged so that simultaneously an additive fuel can be run in one barrel and the reference fuel run in the other. The primary carburetor barrels are modified so that they have removable aluminum inserts (sleeves) in the throttle plate area in order that deposit formed on the inserts in this area can be conveniently weighed.

An unleaded base fuel is first charged to both of the primary barrels and a layer of deposit thus built up on the inserts over 48 hours. The inserts are removed, weighed, and then replaced. The test proper is then started by charging to one barrel a reference fuel which serves as a standard. The test fuel is admitted to the other barrel of the carburetor. The engine is run as the feed is admitted to both barrels; engine blow-by is circulated to an inlet in the carburetor body. The test continues for 48 hours. At the conclusion of the test, the inserts are removed from the carburetor and weighed to determine the difference between the performance of the additive and reference fuels in removing the preformed deposits.

After the aluminum inserts are cleaned, they are replaced in the carburetor and the process is repeated. First the base fuel is used in both barrels to lay down a predeposited layer and then the reference fuel and the test fuel are admitted. In this second portion of the test, the reference fuel is admitted to the barrel to which the test fuel was admitted during the first portion of the test; and the test fuel is admitted to the barrel to which the reference fuel was admitted during the first portion of the test. The test continues for 48 hours. This minimizes effects due to differences in fuel distribution and barrel construction.

The deposit weights in the two portions are averaged, and the effectiveness of the fuel composition of the invention is compared to the reference fuel which contains 60 PTB of a standard commercial carburetor detergent and corrosion inhibitor in the base fuel.

The results of the CCDT-III are set forth below, and indicate that Examples I and II are more effective than Example III. Examples I and II are reaction products formed by using polyoxyalkylene monoamine reactants having approximate molecular weights less than 1000 (i.e. JEFFAMINE M-300 and M-600, respectively), whereas the reaction product of Example III was formed using a polyoxyalkylene monoamine reactant having an approximate molecular weight greater than 1000 (i.e. JEFFAMINE M-1000).

CCDT-III Results

| Sample Tested | Change vs. Commercial Additive (TC 11064) |
|---|---|
| Base Fuel A + 20 PTB Example I | +2 |
| Base Fuel A + 20 PTB Example II | 0 |
| Base Fuel A + 20 PTB Example III | −23 |

The CCDT-KC Test is designed to study the effectiveness of additive fuels in removing previously formed throttle body deposits as well as preventing additional deposit formation. The Chevrolet 350 CID engine is operated at idle and cruise speeds. Crankcase vapors are recirculated to the carburetor as a source for deposit formation and removable carburetor throttle body sleeves are used to collect the deposits. The carburetor is modified to permit dual fuel operation allowing direct comparison of two fuels simultaneously in one engine.

The test method consists of essentially two stages: a buildup phase on untreated fuel to build up deposits followed by a 24-hour run on the test fuel and a reference fuel to determine their effectiveness in preventing additional deposit buildup or even removing deposits. The entire procedure is then repeated with fuel lines to the carburetor reversed to reduce carburetor bias. The carburetor sleeves are subsequently removed and weighed to determine the level of carburetor deposits.

The results of the CCDT-KC are set forth below, and indicate that Examples V and VI are more effective than Example VII in terms of inhibiting carburetor sleeve deposits. Examples V and VI are reaction products formed by using polyoxyalkylene monoamine reactants having approximate molecular weights less than 1000 (i.e. JEFFAMINE M-300 and M-600, respectively), whereas the reaction product of Example VII was formed using a polyoxyalkylene monoamine reactant having an approximate molecular weight greater than 1000 (i.e. JEFFAMINE M-1000).

CCDT-KC Results

| Sample Tested | Carburetor Sleeve Deposits (mg) |
|---|---|
| Base Fuel A + 20 PTB Example V | 0.3 |
| Commercial Fuel | 0.4 |
| Base Fuel A + 20 PTB Example VI | 0.8 |
| Commercial Fuel | 0.6 |
| Base Fuel A + 20 PTB Example VIII | 2.3 |
| Commercial Fuel | 1.0 |

For convenience in shipping and handling, it is useful to prepare a concentrate of the reaction product of the instant invention. The concentrate may be prepared in a suitable liquid solvent such as toluene or xylene, with xylene being particularly preferred. In a preferred mode of preparing a concentrate of the instant invention, approximately 0.1–10.0, preferably 5.0–10.0 weight percent of the reaction product of the instant invention is blended with a major amount of liquid solvent, preferably xylene.

Motor fuel and concentrate compositions of the instant invention may additionally comprise any of the additives generally employed in motor fuel compositions. Thus, compositions of the instant invention may additionally contain conventional carburetor detergents, anti-knock compounds such as tetraethyl lead compounds, anti-icing additives, upper cylinder lubricating oils, and the like. In particular, such additional additives may include compounds such as polyolefin polymers, copolymers, or corresponding hydrogenerated polymers or copolymers of $C_2$–$C_6$ unsaturated hydrocarbons, or mixtures thereof. Additional additives may include substituted or unsubstituted monoamine or polyamine compounds such as alkyl amines, ether amines, and alkyl-alkylene amines or combinations thereof.

It will be evident that the terms and expressions employed herein are used as terms of description and not to limitation. There is no intention, in the use of these descriptive terms and expressions, of excluding equivalents of the features described and it is recognized that various modifications are possible within the scope of the invention claimed.

The invention claimed is:

1. A motor fuel composition comprising a mixture of hydrocarbons boiling in the range from about 90°–450° F. and additionally comprising from about 0.0005–5.0 weight percent of the reaction product obtained by reacting, at a temperature of about 30°–200° C.:

(a) 0.5–2.5 moles of a dibasic acid anhydride;

(b) 0.5–1.5 moles of a polyoxyalkylene monoamine of the formula $$R-(CH_2\underset{\underset{R_1}{|}}{C}HO)_n-R_2-NH_2$$

where R is a $C_1$–$C_{20}$ hydrocarbyl radical, $R_1$ is H or a $C_1$–$C_5$ hydrocarbyl radical, $R_2$ is a $C_1$–$C_{10}$ alkylene group, and n has a value of 1–10; and (c) 0.5–1.5 moles of a hydrocarbyl polyamine of the formula $$R_4(NH-R_3)_x-NH_2$$

where $R_4$ is a $C_1$–$C_{24}$ alkyl radical, $R_3$ is a $C_1$–$C_6$ alkylene group and x has a value from 1–10.

2. A motor fuel composition according to claim 1, where said dibasic acid anhydride is maleic anhydride.

3. A motor fuel composition according to claim 1, where R is a $C_{10}$–$C_{18}$ hydrocarbyl radical.

4. A motor fuel composition according to claim 1, where $R_1$ is a $C_1$–$C_3$ hydrocarbyl radical.

5. A motor fuel composition according to claim 1, where $R_2$ is a $C_1$–$C_5$ alkylene group.

6. A motor fuel composition according to claim 5, where said alkylene group is a propylene group.

7. A motor fuel composition according to claim 1, where n has a value of 1–5.

8. A motor fuel composition according to claim 1, where said polyoxyalkylene monoamine has an approximate molecular weight of less than 1000.

9. A motor fuel composition according to claim 1, where $R_3$ is a $C_1$–$C_3$ alkylene group.

10. A motor fuel composition according to claim 1, where $R_4$ is a $C_{12}$–$C_{20}$ alkyl radical.

11. A motor fuel composition according to claim 1, where said hydrocarbyl polyamine is of the formula $$R_5—NH—(CH_2)_z—NH_2$$

where $R_5$ is an aliphatic $C_8$–$C_{24}$ hydrocarbyl radical and z has a value of 1–5.

12. A motor fuel composition according to claim 11, where $R_5$ is an aliphatic $C_{12}$–$C_{20}$ hydrocarbyl radical, and z has a value of 3.

13. A motor fuel composition according to claim 1, where said hydrocarbyl polyamine is an n-alkyl-alkylene diamine selected from the group consisting of n-coco-1,3-diaminopropane, n-soya-1,3-diaminopropane, n-tallow-1,3-diaminopropane, and n-oleyl-1,3-diaminopropane.

14. A motor fuel composition according to any one of the preceding claims comprising from about 0.001–0.1 weight percent of said reaction product.

* * * * *

UNITED STATES PATENT AND TRADEMARK OFFICE

CERTIFICATE OF CORRECTION

PATENT NO. : 4,865,621

DATED : Sept. 12, 1989

INVENTOR(S) : Rodney Lu-Dai Sung

It is certified that error appears in the above—identified patent and that said Letters Patent is hereby corrected as shown below:

Front Page: Inventor: "Rodney Lu-Dai Sung, Fishkill, NY"

should be

--Rodney Lu-Dai Sung, Fishkill, NY and
Robert Howard Jenkins Jr., Walden, NY--.

Item [19]: "Sung" should read --Sung et al--.

Signed and Sealed this

Sixteenth Day of October, 1990

*Attest:*

HARRY F. MANBECK, JR.

*Attesting Officer*

*Commissioner of Patents and Trademarks*